US006176387B1

(12) United States Patent
Boler

(10) Patent No.: US 6,176,387 B1
(45) Date of Patent: Jan. 23, 2001

(54) BEVERAGE COOLER

(76) Inventor: Anthony Boler, 5910 Wintergrove Dr., Bakersfield, CA (US) 93313

( * ) Notice: Under 35 U.S.C. 154(b), the term of this patent shall be extended for 0 days.

(21) Appl. No.: 09/502,363

(22) Filed: Feb. 18, 2000

(51) Int. Cl.[7] ..... B65D 7/22

(52) U.S. Cl. ..... 220/592.16; 220/592.18; 220/23.88; 220/523

(58) Field of Search ..... 220/592.16, 592.18, 220/23.88, 23.87, 523

(56) References Cited

U.S. PATENT DOCUMENTS

| | | | | |
|---|---|---|---|---|
| D. 298,602 | | 11/1988 | Price . | |
| 2,117,276 | * | 5/1938 | Davis | 220/592.16 |
| 2,123,031 | * | 7/1938 | Weiner | 220/592.16 |
| 2,161,295 | * | 6/1939 | Hirschberg | 220/592.16 |
| 3,220,541 | * | 11/1965 | Wei | 220/592.25 |
| 3,401,535 | * | 9/1968 | Palmer | 220/592.16 |
| 3,565,277 | * | 2/1971 | Sewitch | 220/592.16 |
| 3,591,768 | * | 7/1971 | Torres | 220/592.25 |
| 4,228,908 | * | 10/1980 | Tweeton | 220/592.25 |
| 4,724,681 | | 2/1988 | Bartholomew et al. . | |
| 4,802,344 | | 2/1989 | Livingston et al. . | |
| 4,974,426 | | 12/1990 | Gomez et al. . | |
| 5,048,305 | | 9/1991 | Taub . | |
| 5,261,554 | * | 11/1993 | Forbes | 220/592.16 |
| 5,421,159 | | 6/1995 | Stokes . | |

* cited by examiner

*Primary Examiner*—Joseph M. Moy

(57) ABSTRACT

A beverage cooler for holding beverage containers and fluid therein. The beverage cooler includes a container with a base and a perimeter side wall upwardly extending around the base of the container. The perimeter side wall terminates at an upper edge defining an upper opening into the container. The container has a dividing wall therein which has an interior face. The perimeter side wall and the interior face of the dividing wall define a reservoir with a open top which is designed for holding a fluid therein. The container has a spigot in fluid communication with the reservoir and outwardly extending from the perimeter side wall of the container. The dividing wall has a top face having a pair of bores therein. Each of the bores of the dividing wall has a holding sleeve inserted therein adapted for holding a stack of beverage containers therein.

14 Claims, 2 Drawing Sheets

10
40
39
41
37
31
26
38
21
33
15
34
35
14
42
36
42
32
11
22
30
28
13
27
17
18
25
12
16
24
23

35
33
34
31
26
21
30
29
28
42
20
14
32
19
17
13
16
36

BEVERAGE COOLER

BACKGROUND OF THE INVENTION

1. Field of the Invention

The present invention relates to beverage coolers and dispensers and more particularly pertains to a new beverage cooler for holding beverage containers and fluid therein.

2. Description of the Prior Art

The use of beverage coolers and dispensers is known in the prior art. More specifically, beverage coolers and dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 5,421,159; U.S. Pat. No. 4,724,681; U.S. Patent No. Des. 298,602; U.S. Pat. No. 4,974,426; U.S. Pat. No. 4,802,344; and U.S. Pat. No. 5,048,305.

While these devices fulfill their respective, particular objectives and requirements, the aforementioned patents do not disclose a new beverage cooler. The inventive device includes a container with a base and a perimeter side wall upwardly extending around the base of the container. The perimeter side wall terminates at an upper edge defining an upper opening into the container. The container has a dividing wall therein which has an interior face. The perimeter side wall and the interior face of the dividing wall define a reservoir with a open top which is designed for holding a fluid therein. The container has a spigot in fluid communication with the reservoir and outwardly extending from the perimeter side wall of the container. The dividing wall has a top face having a pair of bores therein. Each of the bores of the dividing wall has a holding sleeve inserted therein adapted for holding a stack of beverage containers therein.

In these respects, the beverage cooler according to the present invention substantially departs from the conventional concepts and designs of the prior art, and in so doing provides an apparatus primarily developed for the purpose of holding beverage containers and fluid therein.

SUMMARY OF THE INVENTION

In view of the foregoing disadvantages inherent in the known types of beverage coolers and dispensers now present in the prior art, the present invention provides a new beverage cooler construction wherein the same can be utilized for holding beverage containers and fluid therein.

The general purpose of the present invention, which will be described subsequently in greater detail, is to provide a new beverage cooler apparatus and method which has many of the advantages of the beverage coolers and dispensers mentioned heretofore and many novel features that result in a new beverage cooler which is not anticipated, rendered obvious, suggested, or even implied by any of the prior art beverage coolers and dispensers, either alone or in any combination thereof.

To attain this, the present invention generally comprises a container with a base and a perimeter side wall upwardly extending around the base of the container. The perimeter side wall terminates at an upper edge defining an upper opening into the container. The container has a dividing wall therein which has an interior face. The perimeter side wall and the interior face of the dividing wall define a reservoir with a open top which is designed for holding a fluid therein.

The container has a spigot in fluid communication with the reservoir and outwardly extending from the perimeter side wall of the container. The dividing wall has a top face having a pair of bores therein. Each of the bores of the dividing wall has a holding sleeve inserted therein adapted for holding a stack of beverage containers therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage cooler apparatus and method which has many of the advantages of the beverage coolers and dispensers mentioned heretofore and many novel features that result in a new beverage cooler which is not anticipated, rendered obvious, suggested, or even implied by any of the prior art beverage coolers and dispensers, either alone or in any combination thereof.

It is another object of the present invention to provide a new beverage cooler which may be easily and efficiently manufactured and marketed.

It is a further object of the present invention to provide a new beverage cooler which is of a durable and reliable construction.

An even further object of the present invention is to provide a new beverage cooler which is susceptible of a low cost of manufacture with regard to both materials and labor, and which accordingly is then susceptible of low prices of sale to the consuming public, thereby making such beverage cooler economically available to the buying public.

Still yet another object of the present invention is to provide a new beverage cooler which provides in the apparatuses and methods of the prior art some of the advantages thereof, while simultaneously overcoming some of the disadvantages normally associated therewith.

Still another object of the present invention is to provide a new beverage cooler for holding beverage containers and fluid therein.

Yet another object of the present invention is to provide a new beverage cooler which includes a container with a base and a perimeter side wall upwardly extending around the base of the container. The perimeter side wall terminates at an upper edge defining an upper opening into the container. The container has a dividing wall therein which has an interior face. The perimeter side wall and the interior face of the dividing wall define a reservoir with a open top which is designed for holding a fluid therein. The container has a spigot in fluid communication with the reservoir and outwardly extending from the perimeter side wall of the container. The dividing wall has a top face having a pair of bores therein. Each of the bores of the dividing wall has a holding sleeve inserted therein adapted for holding a stack of beverage containers therein.

Still yet another object of the present invention is to provide a new beverage cooler that may be used to keep beverage containers and fluids stored therein cool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
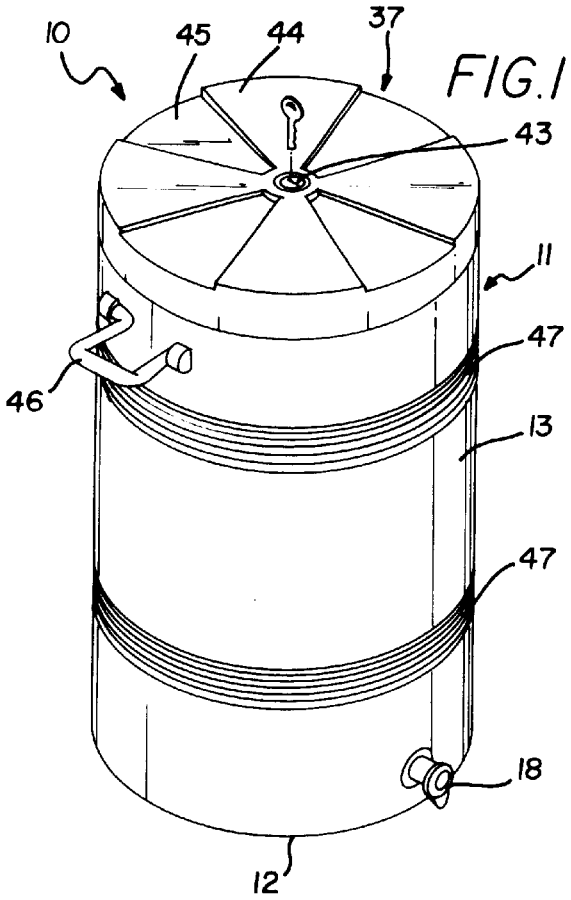
FIG. 1 is a schematic perspective view of a new beverage cooler adapted for holding stacks of six 12-oz beverage cans according to the present invention.
Figure 2:
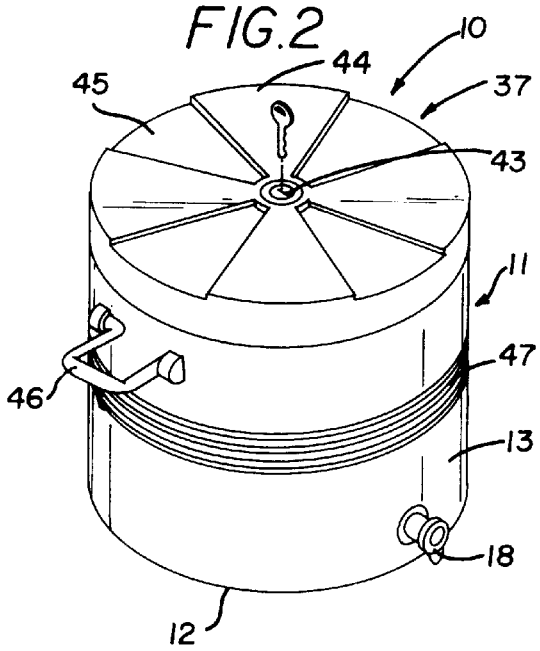
FIG. 2 is a schematic perspective view of an embodiment of the present invention adapted for holding stacks of three 12-oz beverage cans.
Figure 3:
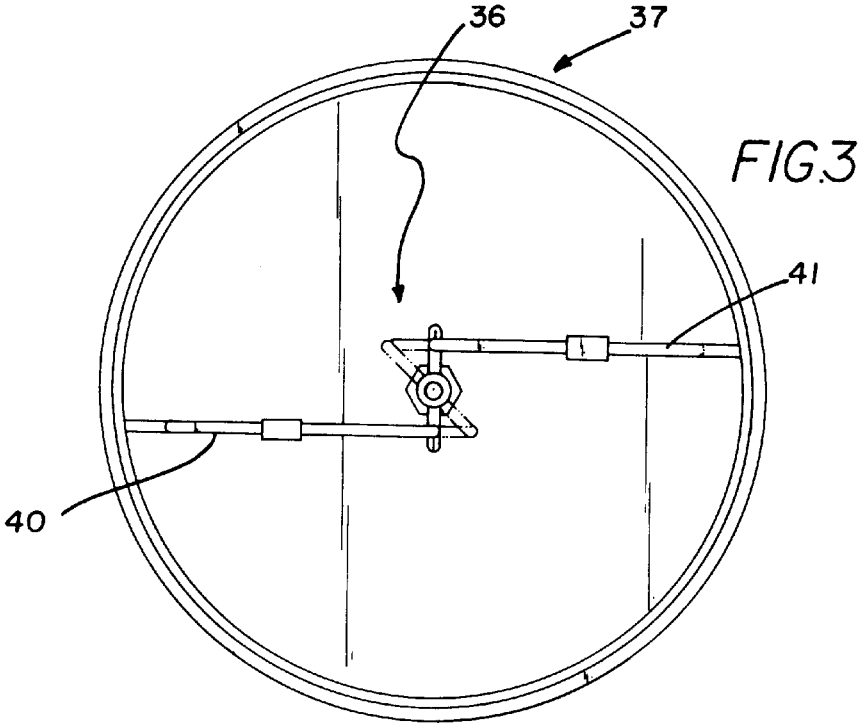
FIG. 3 is a schematic bottom view of the lid of the present invention.
Figure 4:
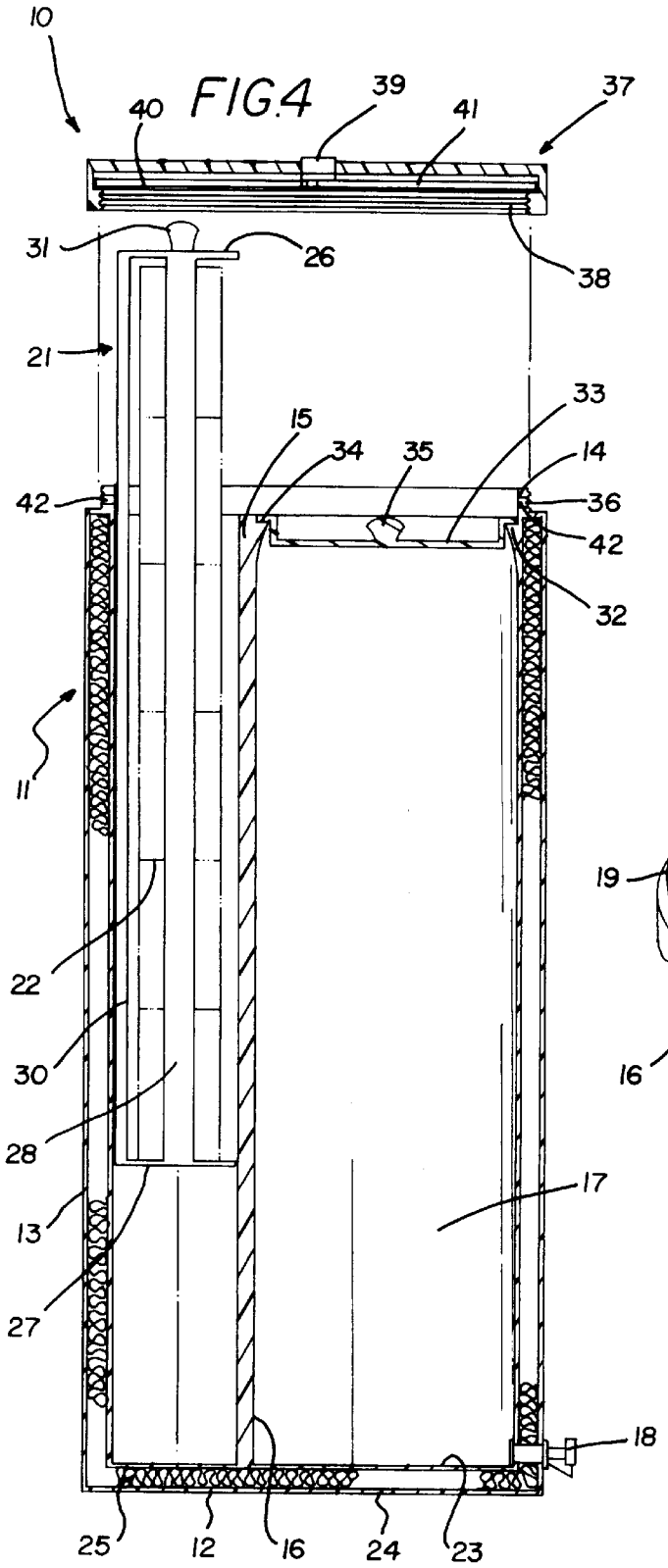
FIG. 4 is a schematic vertical cross sectional view of the present invention.
Figure 5:
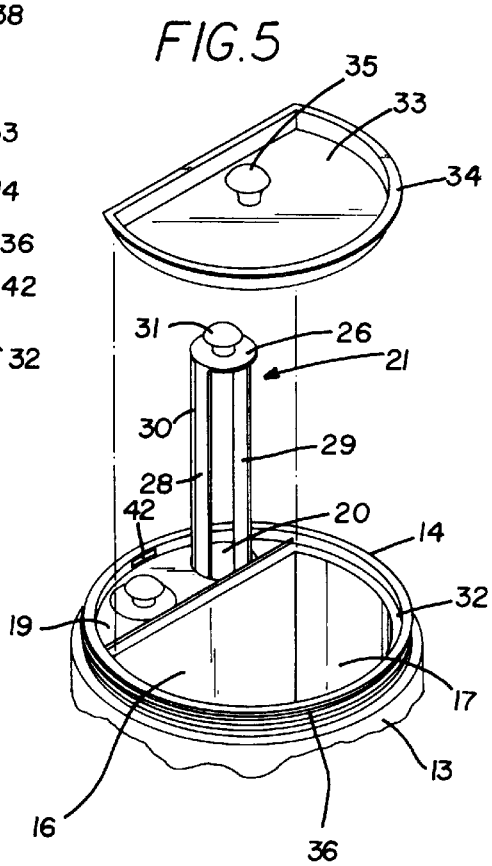
FIG. 5 is a schematic exploded partial perspective view of the present invention.

With reference now to the drawings, and in particular to FIGS. 1 through 5 thereof, a new beverage cooler embodying the principles and concepts of the present invention and generally designated by the reference numeral 10 will be described.

As best illustrated in FIGS. 1 through 5, the beverage cooler 10 generally comprises a container 11 with a base 12 and a perimeter side wall 13 upwardly extending around the base of the container. The perimeter side wall terminates at an upper edge 14 defining an upper opening into the container. The container has a dividing wall 15 therein which has an interior face 16. The perimeter side wall and the interior face of the dividing wall define a reservoir 17 with a open top which is designed for holding a fluid therein. The container has a spigot 18 in fluid communication with the reservoir and outwardly extending from the perimeter side wall of the container. The dividing wall has a top face 19 having a pair of bores 20 therein. Each of the bores of the dividing wall has a holding sleeve 21 inserted therein adapted for holding a stack of beverage containers 22 therein.

In closer detail, the container is generally cylindrical and has a center axis, a generally circular base and a generally cylindrical perimeter side wall upwardly extending around the base of the container. The perimeter side wall terminates at an annular upper edge defining a generally circular upper opening into the container. The container preferably comprises spaced apart coextensive inner and outer layers 23,24 each comprising a water impermeable material such as a rigid plastic for preventing passage of water therethrough. The container also preferably has a coextensive insulating layer 25 interposed between the inner and outer layers of the container. The insulating layer of the container has a greater inhibition to the conduction of heat therethrough than the inner and outer layers of the container. In other words, the insulating layer has a greater r-value than the inner and outer layers of the container to help keep items in the cooler cool for an extended time.

The container has a dividing wall therein. The dividing wall has a generally rectangular interior face. The perimeter side wall and the interior face of the dividing wall define a reservoir having a open top. In use, the reservoir is designed for holding a fluid and ice therein. The container has a push button spigot outwardly extending from the perimeter side wall of the container. The spigot is in fluid communication with the reservoir of the container to permit passage of fluid out of the reservoir through the spigot. The spigot is preferably positioned towards the base of the container.

The dividing wall has a top face spaced below the upper edge of the perimeter side wall. The top face of the dividing wall has a pair of generally cylindrical bores therein extending towards the base of the container. The bores of the dividing wall each have a center axis generally perpendicular to the base of the container. Each of the bores of the dividing wall has a holding sleeve inserted therein. Each of the holding sleeves has spaced apart generally disk shaped top and bottom panels 26,27 and a plurality of spaced apart generally parallel elongate side rails 28,29,30 extending between the top and bottom panels of the respective holding sleeve to connect the top and bottom panels of the respective holding sleeve together. Each of the holding sleeves is designed for holding a stack of beverage containers therein between the top and bottom panels of the respective holding sleeve. Preferably, the top and bottom panels of each of the holding sleeves are spaced apart to received therebetween a stack of at least three twelve-ounce beverage cans. In another preferred embodiment, each of the holding sleeves should be able to receive a stack of at least six beverage cans therein. A first and a second of the side rails 28,29 of each of the holding sleeves define a space therebetween sized for permitting passage of a beverage container therethrough to permit insertion into and removal from the respective holding sleeve of the beverage container. Preferably, the space between the first and second side rails of each of the holding sleeves is sized to permit passage therethrough of a twelve-ounce beverage can such as a 12 oz soft drink or beer can. Preferably, the top panel of each of the holding sleeves has a lifting knob 31 to aid lifting of the respective holding sleeve from the associated bore of the top face of the dividing wall.

The interior face and the perimeter side wall has a upper shoulder 32 extending around the open top of the reservoir of the container. The shoulder generally lies in plane generally parallel to the base of the container. The shoulder is spaced below the upper edge of the perimeter side wall and the top face of the dividing wall. A tray 33 having a generally D-shaped outer perimeter is inserted into the open top into the reservoir to substantially close the open top of the reservoir. The tray forms a depression designed for receiving fluid and item therein. Preferably, the tray frictionally engaging the sides of the reservoir to frictionally releasably hold the tray in position covering the reservoir. The tray also has an outwardly extending lip 34 resting on the shoulder. Ideally, the tray includes an upwardly extending lifting handle 35 for aiding lifting the tray off of the reservoir.

The perimeter wall has an external threaded portion 36 adjacent the upper edge of the container. A lid 37 is provided to substantially cover the upper opening of the container. The lid has an internal threaded portion 38 that is threadably coupled to the external threaded portion of the perimeter side wall. The lid also preferably has a locking mechanism 39 for locking the lid to the container. The locking mechanism includes a pair of retractably extendable locking arms 40,41 extending in opposite directions from one another. The locking arms are retractably insertable into corresponding slot 42 in the perimeter side wall to lock the lid to the container. The locking mechanism has a key slot 43 for inserting a key to turn a lock barrel which in turn extends and retracts the locking arms.

Ideally, the lid has an upper surface 44 having a plurality of generally triangular recesses 45 outwardly radiating from a center of the upper surface of the lid. The recesses are designed for receiving beverage cans thereon.

The container has a pair of handles 46 pivotally coupled to the perimeter side wall for aiding carrying of the container. The perimeter side wall ideally also has a plurality of annular outer grooves 47 therearound the outer grooves is designed for aiding gripping of the perimeter side wall when holding the perimeter side wall.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooler, comprising:

a container having a base and a perimeter side wall upwardly extending around said base of said container;

said perimeter side wall terminating at an upper edge defining an upper opening into said container;

said container having a dividing wall therein, said dividing wall having an interior face, said perimeter side wall and said interior face of said dividing wall defining a reservoir having a open top, said reservoir being for holding a fluid therein;

said container having a spigot outwardly extending from said perimeter side wall of said container, said spigot being in fluid communication with said reservoir of said container;

said dividing wall having a top face, said top face of said dividing wall having a pair of bores therein extending towards said base of said container; and each of said bores of said dividing wall having a holding sleeve inserted therein, each of said holding sleeves being adapted for holding a stack of beverage containers therein.

2. The cooler of claim 1, wherein said container comprise spaced apart inner and outer layers each comprising a water impermeable material for preventing passage of water therethrough, said container comprising an insulating layer interposed between said inner and outer layers of said container, said insulating layer of said container having a greater inhibition to the conduction of heat therethrough than said inner and outer layers of said container.

3. The cooler of claim 1, wherein said spigot is positioned towards said base of said container.

4. The cooler of claim 1, wherein each of said holding sleeves has spaced apart generally disk shaped top and bottom panels and a plurality of spaced apart elongate side rails extending between said top and bottom panels of the respective holding sleeve, each of said holding sleeves being adapted for holding a stack of beverage containers therein between said top and bottom panels of the respective holding sleeve.

5. The cooler of claim 4, wherein a first and a second of said side rails of each of said holding sleeves defining a space therebetween sized for permitting passage of a beverage container therethrough to permit insertion into and removal from the respective holding sleeve of the beverage container.

6. The cooler of claim 5, wherein said space between said first and second side rails of each of said holding sleeves is sized to permit passage therethrough of a 12 ounce beverage can.

7. The cooler of claim 4, wherein said top panel of each of said holding sleeves has a lifting knob to aid lifting of the respective holding sleeve from the associated bore of said top face of said dividing wall.

8. The cooler of claim 1, further comprising a tray being inserted into said open top into said reservoir to substantially close said open top of said reservoir.

9. The cooler of claim 8, wherein said tray frictionally engages the sides of said reservoir to frictionally releasably hold said tray in position covering said reservoir.

10. The cooler of claim 8, wherein said interior face and said perimeter side wall have an upper shoulder extending around said open top of said reservoir of said container, said shoulder generally lying in plane generally parallel to said base of said container, said shoulder being spaced below said upper edge of said perimeter side wall and said top face of said dividing wall, and wherein said tray has an outwardly extending lip resting on said shoulder.

11. The cooler of claim 8, wherein said tray has an upwardly extending lifting handle for aiding lifting said tray off of said reservoir.

12. The cooler of claim 1, further comprising a lid substantially covering said upper opening of said container.

13. The cooler of claim 12, wherein said lid is threadably coupled to of said perimeter side wall.

14. A cooler, comprising:

a container begin generally cylindrical and having a center axis, a generally circular base and a generally cylindrical perimeter side wall upwardly extending around said base of said container;

said perimeter side wall terminating at an annular upper edge defining a generally circular upper opening into said container;

said container comprising spaced apart inner and outer layers each comprising a water impermeable material for preventing passage of water therethrough;

said container comprising an insulating layer interposed between said inner and outer layers of said container, said insulating layer of said container having a greater inhibition to the conduction of heat therethrough than said inner and outer layers of said container;

said container having a dividing wall therein, said dividing wall having a generally rectangular interior face, said perimeter side wall and said interior face of said dividing wall defining a reservoir having a open top, said reservoir for holding a fluid therebetween;

said container having a spigot outwardly extending from said perimeter side wall of said container, said spigot being in fluid communication with said reservoir of said container, said spigot being positioned towards said base of said container;

said dividing wall having a top face spaced below said upper edge of said perimeter side wall, said top face of said dividing wall having a pair of generally cylindrical bores therein extending towards said base of said container, said bores of said dividing wall each having a center axis generally perpendicular to said base of said container;

each of said bores of said dividing wall having a holding sleeve inserted therein, each of said holding sleeves having spaced apart generally disk shaped top and bottom panels and a plurality of spaced apart elongate side rails extending between said top and bottom panels of the respective holding sleeve, each of said holding sleeves being adapted for holding a stack of beverage containers therein between said top and bottom panels of the respective holding sleeve;

a first and a second of said side rails of each of said holding sleeves defining a space therebetween sized for permitting passage of a beverage container therethrough to permit insertion into and removal from the respective holding sleeve of the beverage container, wherein said space between said first and second side rails of each of said holding sleeves is sized to permit passage therethrough of a 12 ounce beverage can;

said top panel of each of said holding sleeves having a lifting knob to aid lifting of the respective holding sleeve from the associated bore of said top face of said dividing wall;

said interior face and said perimeter side wall having a upper shoulder extending around said open top of said reservoir of said container, said shoulder generally lying in plane generally parallel to said base of said container, said shoulder being spaced below said upper edge of said perimeter side wall and said top face of said dividing wall;

a tray being inserted into said open top into said reservoir to substantially close said open top of said reservoir, said tray frictionally engaging the sides of said reservoir to frictionally releasably hold said tray in position covering said reservoir, said tray having an outwardly extending lip resting on said shoulder, said tray having an upwardly extending lifting handle for aiding lifting said tray off of said reservoir;

a lid substantially covering said upper opening of said container, said lid being threadably coupled to of said perimeter side wall; and said lid having a locking mechanism for locking said lid to said container, said locking mechanism comprising a pair of retractably extendable locking arms, said locking arms being retractably insertable into corresponding slot in said perimeter side wall to lock said lid to said container.

* * * * *